US011548028B2

(12) United States Patent
Gao et al.

(10) Patent No.: US 11,548,028 B2
(45) Date of Patent: Jan. 10, 2023

(54) AIR-ASSISTED ELECTROSTATIC ULTRASONIC ATOMIZATION NOZZLE AND METHOD

(71) Applicant: JIANGSU UNIVERSITY, Zhenjiang (CN)

(72) Inventors: Jianmin Gao, Zhenjiang (CN); Anjun Ai, Zhenjiang (CN)

(73) Assignee: JIANGSU UNIVERSITY, Zhenjiang (CN)

( * ) Notice: Subject to any disclaimer, the term of this patent is extended or adjusted under 35 U.S.C. 154(b) by 0 days.

(21) Appl. No.: 17/607,412

(22) PCT Filed: Jun. 24, 2021

(86) PCT No.: PCT/CN2021/102021

§ 371 (c)(1),
(2) Date: Oct. 29, 2021

(87) PCT Pub. No.: WO2021/259349

PCT Pub. Date: Dec. 30, 2021

(65) Prior Publication Data

US 2022/0040722 A1 Feb. 10, 2022

(30) Foreign Application Priority Data

Jun. 24, 2020 (CN) ..... 202010587848.4

(51) Int. Cl.
*B05B 17/06* (2006.01)

(52) U.S. Cl.
CPC ..... *B05B 17/0607* (2013.01)

(58) Field of Classification Search
CPC ..... C02F 1/005; B05B 1/34; B05B 1/3415; B05B 17/06; B05B 17/0692;
(Continued)

(56) References Cited

U.S. PATENT DOCUMENTS 4,101,246 A * 7/1978 Erickson ..... F04F 5/10 417/171
5,810,259 A * 9/1998 Sinclair ..... B05B 1/3415 239/487
(Continued)

FOREIGN PATENT DOCUMENTS

CN 2699997 Y 5/2005
CN 105834054 A 8/2016
(Continued)

*Primary Examiner* — Christopher R Dandridge
(74) *Attorney, Agent, or Firm* — Bayramoglu Law Offices LLC

(57) ABSTRACT

An air-assisted electrostatic ultrasonic atomization nozzle includes an intake sleeve, a Laval tube, a resonant body and a jet element body. The left end of the intake sleeve is equipped with the air intake, and the right end of the air inlet sleeve is connected with the left end of the Laval tube. The right end of the Laval tube is connected with the left end of the resonant body. The right end of the resonant body is connected with the left end of the jet element body. The sealing surface of the resonant tube is arranged between the resonant body and the jet element body. The sealing surface of the resonant tube obstructs the gas-liquid in the axial direction of the resonant body and the jet element body. The resonant body has a resonant chamber, and the sidewall of the resonant body is equipped with a V-shaped resonant tube.

14 Claims, 2 Drawing Sheets

(58) Field of Classification Search
CPC ... B05B 17/0607; B05B 7/066; B05B 7/2424; B05B 7/0433; B05B 2/3415; B05B 17/0623; B05B 17/063; B05B 17/0433; B05B 17/0615; B05B 1/341; G01K 5/02; B01F 23/40; B01F 31/85
See application file for complete search history.

(56) References Cited

U.S. PATENT DOCUMENTS

| | | | | |
|---|---|---|---|---|
| 2019/0054492 | A1* | 2/2019 | Gao | B05B 17/0607 |
| 2020/0130007 | A1* | 4/2020 | Gao | B05B 7/10 |

FOREIGN PATENT DOCUMENTS

| | | | |
|---|---|---|---|
| CN | 111889292 | A | 11/2020 |
| EP | 2974796 | B1 | 5/2017 |
| RU | 2281812 | C2 | 8/2006 |

* cited by examiner

AIR-ASSISTED ELECTROSTATIC ULTRASONIC ATOMIZATION NOZZLE AND METHOD

CROSS REFERENCE TO THE RELATED APPLICATIONS

This application is the national phase entry of International Application No. PCT/CN2021/102021, filed on Jun. 24, 2021, which is based upon and claims priority to Chinese Patent Application No. 202010587848.4, filed on Jun. 24, 2020, the entire contents of which are incorporated herein by reference.

TECHNICAL FIELD

The proposed device belongs to the field of agricultural engineering atomization and cultivation and relates to an air-assisted electrostatic ultrasonic atomization nozzle and its method.

BACKGROUND

Since 1988, the first electrostatic spraying technology has been successfully promoted in China. Compared with conventional spraying technology, electrostatic spraying technology has obvious advantages. Mist droplets have large coverage and small particle size, which improves the effective utilization rate of liquid pesticides and fundamentally reduces environmental pollution and labor intensity, thereby reducing the cost.

Ultrasonic atomization uses the dynamic action of fluid to generate ultrasonic waves to produce cavitation atomization droplets into small molecular droplets. Compared with other atomization technologies, it has the advantages of low cost, small droplet size, uniform distribution and large atomization volume. Ultrasonic atomization technology is widely used in pesticide equipment, agricultural atomization cultivation, industrial dust removal, sewage treatment and many other applications.

The gas-assisted electrostatic ultrasonic atomization nozzle has the advantages of a long service life, good spray effect and high reliability. At present, according to the existing spraying technology in the field of agricultural engineering, the development and research of various nozzles are still being improved. Therefore, the level of electrostatic ultrasonic atomization technology has many places worthy of further study.

SUMMARY

Aiming at the deficiencies of prior technology, the present invention provides a gas-assisted electrostatic ultrasonic atomization nozzle, which aims to make the fog drops carry static electricity and accelerate and refine the mist droplets multiple times.

To achieve the above objectives, the present invention adopts the following technical solution:

An air-assisted electrostatic ultrasonic atomization nozzle comprising an intake sleeve, Laval tube, resonant body and jet element body. The left end of the intake sleeve is equipped with air intake, and the right end of the intake sleeve is connected with the left end of the Laval tube. The right end of the Laval tube is connected with the left end of the resonant body, and the right end of the resonant body is connected with the left end of the jet element body. The sealing surface of the resonance tube is arranged between the resonant body and the jet element body and allows the gas in the resonant body to enter the jet element body through the gas diversion hole of the V-shaped resonant tube. The resonant body has a resonant chamber, and the sidewall of the resonant body is equipped with a V-shaped resonant tube. Furthermore, the V-shaped resonant tube is connected with the gas diversion hole of the jet element body. The jet element body is also equipped with a liquid inlet and a diversion chamber. The liquid enters the diversion chamber through the liquid inlet, and then is blown by the gas entered by the gas diversion hole to the rotating device to be ejected through an air-mist outlet.

Accordingly, the rotary device comprises a piezoelectric sphere and a vortex blade. The piezoelectric sphere is ellipsoidal, the outer contour is coated with piezoelectric material, and several vortex blades are provided on the piezoelectric sphere.

The rotary device is arranged in the piezoelectric sphere moving chamber and supported by a supporting rod. The piezoelectric sphere moving chamber is arranged in the jet element body.

Additionally, the middle section of the piezoelectric sphere moving chamber is a contraction and expansion tube, and the left end of the middle section of the piezoelectric sphere is gradually expanded. The right end of the middle section of the piezoelectric sphere moving chamber is gradually tapered and contracted.

The outer contour of the piezoelectric sphere and the inner contour of the piezoelectric sphere moving chamber are based on the parameters of the Laval tube.

Furthermore, the structure of the resonant chamber is a step type, the left end and the middle section diameters of the resonant chamber are 9 to 11 mm and 5 to 7 mm, respectively, and the right expansion end diameter is 8 to 10 mm.

The liquid inlet is arranged up and down relative to the gas diversion hole.

There is a gap between the outlet of the diversion chamber and the sealing surface of the resonance tube, and the gap is 1 to 2 mm. The height difference of the upper and lower wall surfaces of the diversion chamber is 2 to 3 mm.

In addition, the twist angle of the vortex blade is provided at 45°.

In terms of the working method of air-assisted electrostatic ultrasonic nozzle, after certain pressure of gas enters into the Laval tube through the air intake, it is rapidly accelerated from subsonic to supersonic, and the supersonic flow is formed at the exit of the Laval tube. Then, supersonic air flows into a stepped resonant chamber, and at the same time, a shock wave is generated at the entrance of the resonant chamber. As the pressure in the resonance chamber increases, the shock wave gradually moves away from the entrance. Therefore, the ultrasonic vibration of the high-speed gas flow in the stepped resonant chamber causes the ultrasonic vibration of the sealing surface of the resonant tube. At the same time, the droplets flow from the outlet of the diversion cavity through the liquid inlet to the outer end of the sealing surface of the resonance tube, which causes the droplet to produce ultrasonic vibration and break. As the static pressure of the sidewall orifice of the resonant body decreases gradually, the gas flows out of the V-shaped resonant tube, and the gas flows through the gas diversion hole to reach the second atomization after converging with the liquid drops at the left side face of the jet element. After that, the high-speed gas-liquid mixture impinges on the vortex blade, which makes the gas-liquid mixture hit the vortex at a high speed. At the same time, the piezoelectric sphere is driven to rotate rapidly and accelerate the fluid in a short time. At this time, the fluid exerts a certain pressure on the surface of the piezoelectric sphere so that the piezoelectric material produces a positive piezoelectric effect on the surface of the piezoelectric sphere. Both the inner and outer surfaces of the piezoelectric material have positive and negative charges, and the droplets are positively charged through the surface of the piezoelectric sphere. The high-speed gas-liquid mixture is accelerated to supersonic speed through the Laval tube formed by the outer wall of the piezoelectric sphere and the inner wall of the moving chamber of the piezoelectric sphere. Therefore, the mist droplets are further atomized in this process, and finally, the supersonic mist droplets with electrostatic charge are ejected from the air-mist outlet.

The beneficial effects of the present invention are as follows.

6. The present invention combines the Laval principle and the working principle of the resonant body. After the piezoelectric material is subjected to external pressure, a positive piezoelectric effect is generated. At the same time, positive and negative charges appear on the inner and outer surfaces of the piezoelectric material, and the mist droplets pass through the outer surface and become positively charged. The high-speed gas-liquid mixture hits the vortex blade, causing the gas-liquid mixture to spiral into the vortex at a high speed. At the same time, the piezoelectric sphere is driven to rotate rapidly and accelerate the fluid in a short time. According to the parameters of the Laval tube, the outer and inner wall contours of the piezoelectric sphere moving chamber were designed. That is, the upper and lower tubes are formed by the piezoelectric sphere and the inner wall of the middle section. Therefore, the droplets are further accelerated and refined.

7. The gas with a certain speed enters the Laval tube through the air inlet and accelerates from subsonic speed to supersonic speed, forming a high-speed airflow at the exit of the Laval tube.

8. The high-speed airflow forms an ultrasonic oscillation in the stepped resonant tube, which drives the sealing surface of the resonant tube to produce ultrasonic oscillation together so that the droplets are broken on the outer end of the sealing surface, forming the first refinement. The V-shaped resonant tube is installed on the sidewall of the resonant body and connected with the air hole of the jet element body so that the refined liquid droplets on the sealing surface are blown into the piezoelectric sphere moving chamber after secondary atomization.

9. The gas-liquid mixture enters the piezoelectric sphere moving chamber and impacts the vortex blade. The fluid accelerates in a short time so that the piezoelectric sphere rotates. To ensure the normal rotation of the piezoelectric sphere, the right end of the piezoelectric sphere is fixed by the rotating tip. At the same time, when the high-speed gas-liquid mixture exerts a certain pressure on the piezoelectric sphere, the piezoelectric material produces a positive piezoelectric effect. Positive and negative charges appear on the inner and outer surfaces of the piezoelectric material, causing mist droplets to pass through the surface with positive charges.

10. The purpose of setting the sealing surface of the resonant tube is to ensure that the gas in the resonant body is not directly added to the jet element. The airflow enters through the gas diversion hole in the jet element body so that the liquid in the jet element is blown to the rotating device.

In these figures, the elements are numbered as follows: 1—air intake, 2—intake sleeve, 3—Laval tube, 4—resonant body, 5—resonant chamber, 6—sealing surface of the resonance tube, 7—liquid inlet, 8—diversion chamber, 9—jet element body, 10—air-mist outlet, 11—supporting rod, 12—piezoelectric sphere, 13—vortex blade, 14—gas diversion hole, 15—AV-shaped resonant tube, and 16—piezoelectric sphere moving chamber.

DETAILED DESCRIPTION OF THE EMBODIMENTS

Embodiments of the proposed device are described in detail below, and examples of the embodiment are shown in the accompanying drawings. From the beginning to the end, the same and similar label denotes the same and similar element or element having the same or similar functions. The embodiments described below in conjunction with the drawings are exemplary to explain the invention and should not be construed as limiting the present invention.

There are some positional words in the writing of the present invention, such as lower, upper, sidewall, inner wall, left end, right end, one end, and the other end of the position words, which are only for the convenience of description and understanding of the schematic diagram. However, this does not mean that the actual object needs to strictly follow the requirements for operation. In addition, there are some simple commonly used terms in the present invention, such as fixed, installed, connected and other terms that should be taken as the meaning of the general understanding. For example, the word "connected" can be understood as the connection between two parts of thread or glue. Professional and technical personnel need to understand this issue under specific circumstances.

In the present invention, unless otherwise specified and limited, the terms "installation", "connection", "connection", "fixing", etc. should be understood in a broad sense. For example, connections can be fixed, detachable, or monolithic. More importantly, it can also be a mechanical connection, an electrical connection, a direct connection, an indirect connection through an intermediate, or an internal connection between two components. A person of ordinary skill in this field can understand the specific meaning of the above terms in the present invention.

Embodiments of the present invention will be described in combination with the accompanying drawings.

Figure 1:
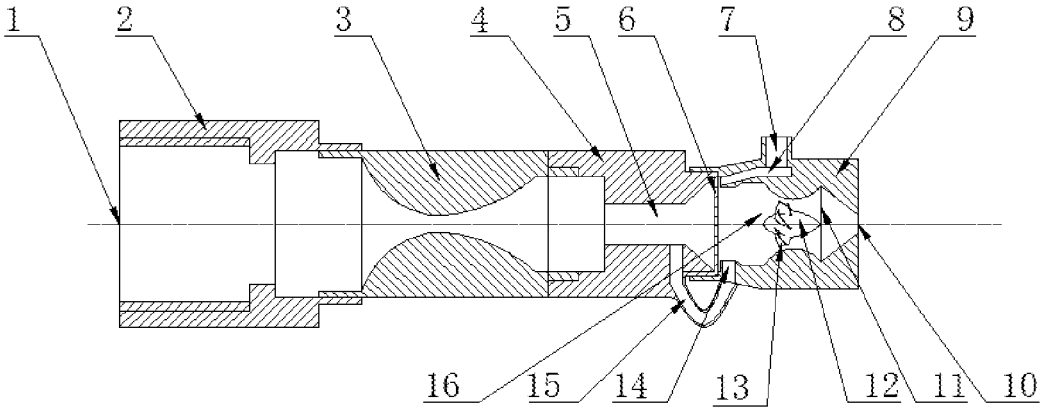
FIG. 1 is a structural diagram of the gas-assisted electrostatic ultrasonic atomization nozzle of the present invention.

As shown in FIG. 1, the air-assisted electrostatic ultrasonic atomization nozzle of the present invention is composed of the following: air intake 1, intake sleeve 2. Laval tube 3, resonant body 4, resonant chamber 5, sealing surface of the resonance tube 6, liquid inlet 7, the diversion chamber 8, jet element body 9, air-mist outlet_10, supporting rod 11, piezoelectric sphere 12, vortex blade 13, gas diversion hole 14, V-shaped resonant tube 15, and piezoelectric sphere moving chamber 16.

Air inlet 1 is installed at the center of the left end of air inlet sleeve 2, the right end of intake sleeve 2 is connected to the left end of Laval tube 3, and the right end of Laval tube 3 is connected to the left end of resonant body 4. The interior of resonant body 4 is equipped with stepped resonant chamber 5 to improve the resonance effect of the air flow in the resonant chamber. The sidewall of resonant body 4 is equipped with V-shaped resonant tube 15, and the right end of resonant body 4 is the sealing surface of resonant tube 6. Moreover, the right end of resonant body 4 is connected with the left end of jet element body 9. The purpose is to prevent the gas in resonant body 4 from directly entering jet element body 9, and the airflow enters through gas diversion hole 14 in jet element body 9, thus blowing the liquid in jet element body 9 to the rotating device. The jet element body 9 material of the present invention is polytetrafluoroethylene (PTFE), which has the advantages of corrosion resistance, high temperature resistance, good wear resistance, and good electrical insulation performance. The torsion angle of the vortex blade is set to 45° so that the high-speed gas-liquid mixing effect is better.

The upper sidewall of jet element body 9 is equipped with liquid inlet 7, liquid inlet 7 is connected with diversion chamber 8, and diversion chamber 8 is located on the upper wall of jet element body 9. There is a distance of 1 to 2 mm between the liquid outlet of diversion chamber 8 and the sealing surface of resonant tube 6. To ensure that the outflowing droplets can be fully ultrasonically vibrated on the sealing surface of resonant tube 6 and broken into fine droplets. Gas diversion hole 14 on the lower left side of jet element body 9 is connected with a V-shaped resonant tube 15, wherein the center part of jet element body 9 is equipped with piezoelectric sphere moving chamber 16, and six vortex blades 13 are arranged on the surface of piezoelectric sphere 12. The right end of piezoelectric sphere 12 is equipped with a tip contact. Both ends of supporting rod 11 are fixedly installed at the maximum diameter of the expansion end of the inner wall of piezoelectric sphere moving chamber 16, the center of supporting rod 11 is connected with the tip contact, and the center of the right end of jet element body 9 is equipped with air-mist outlet 10.

Figure 2:
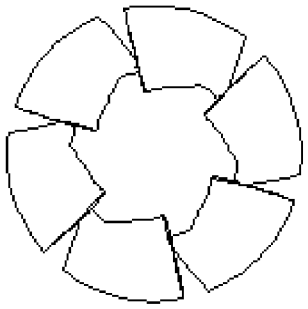
FIG. 2 is a left view of the piezoelectric sphere and the vortex blade of the present invention.

As shown in FIG. 2, the shape of piezoelectric sphere 12 is ellipsoid. The two ends of piezoelectric sphere 12 have different sizes. Vortex blade 13 is installed at the large end of piezoelectric sphere 12, and vortex blade 13 is designed to ensure the introduction of a gas-liquid mixture into it by rotation of the blade. At the same time, under the action of a high-speed gas-liquid mixture, vortex blade 13 can be driven to rotate piezoelectric sphere 12 and form a short acceleration time to the fluid.

Figure 3:
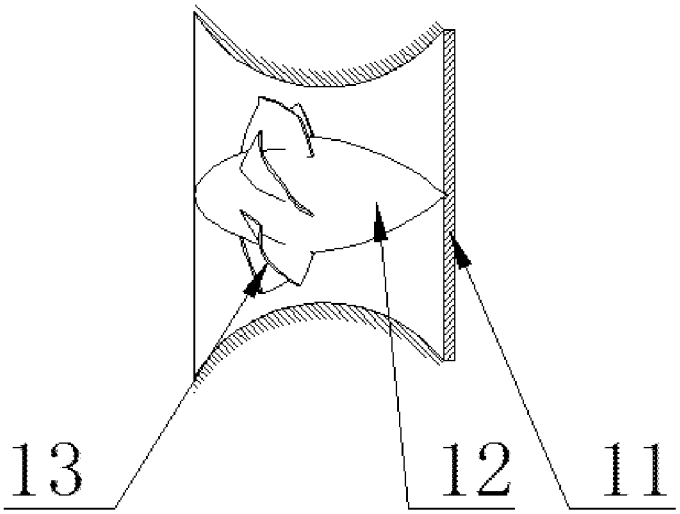
FIG. 3 is a schematic diagram of the piezoelectric sphere with the inner wall of the moving chamber of the piezoelectric sphere forming a Laval tubular shape and connecting the top of the piezoelectric sphere with the center of the supporting rod.

As shown in FIG. 3, piezoelectric sphere 12 forms a Laval tube shape with the inner wall of piezoelectric sphere moving chamber 16. The tip of piezoelectric sphere 12 connects with the center of supporting rod 11. The piezoelectric sphere moving chamber 16 is in the shape of an inner wall contraction and expansion tube. The outer contour of the piezoelectric sphere 12 and the inner contour of the piezoelectric sphere moving chamber 16 were designed according to the parameters of Laval tube 3. However, the upper and lower tubes formed by piezoelectric sphere 12 and the inner wall of the middle segment of piezoelectric sphere moving chamber 16. To facilitate the Laval effect of the gas-liquid mixture through the formed channel, the gas-liquid mixture is further accelerated to a supersonic ejection. The outer surface of piezoelectric sphere 12 is covered with a layer of piezoelectric material. When a certain pressure is applied to piezoelectric sphere 12 by the gas liquid mixture, the piezoelectric material generates a positive piezoelectric effect. The end of piezoelectric sphere 12 is provided with a tip, which is connected to the center of supporting rod 11. Supporting rod 11 is fixed at the maximum diameter of the expansion end of the inner wall of piezoelectric sphere moving chamber 16 to ensure the normal rotation of piezoelectric sphere 12.

Figure 4:
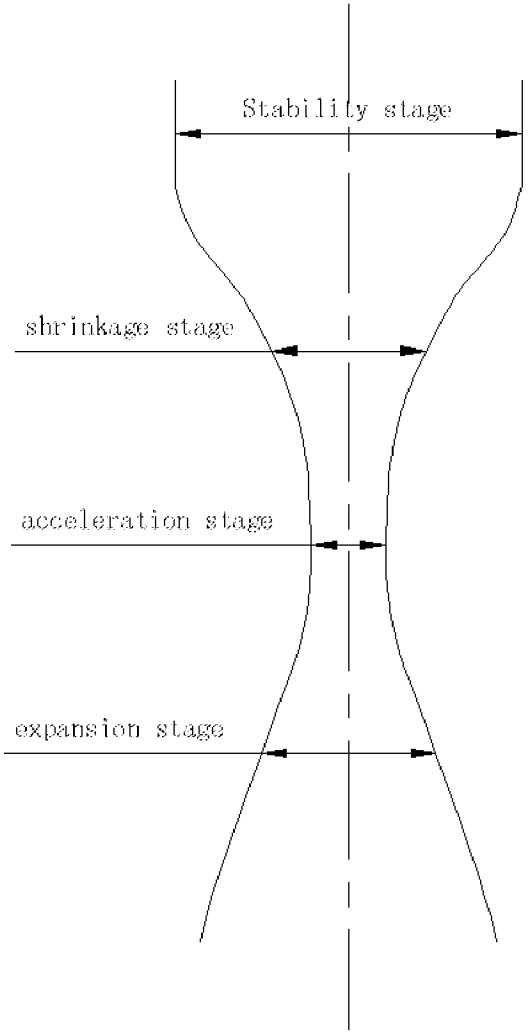
FIG. 4 is a schematic diagram of the Laval tube flow line of the present invention.

As shown in FIG. 4, a schematic diagram of the Laval tube flow line of the present invention, the inlet diameter of Laval tube 3 is 12 to 14 mm, the throat diameter is 3 to 4 mm, and the outlet diameter is 9 to 11 mm. Under normal working conditions, the flow passes through the contraction phase at a subsonic speed. It passes through the throat of the acceleration phase at a sonic speed and into the expansion phase at a supersonic speed until the exit. The formula is as follows:

$$\frac{dA}{A} = \frac{u}{a^2}du - \frac{du}{u} = \frac{u^2}{a^2}\frac{du}{u} - \frac{du}{u} = (M^2 - 1)\frac{du}{u}$$

where "M" is the Mach number of the airflow. It can be seen from the formula that in the subsonic flow phase, when "M<1", if "du>0", then "dA<0"; and if "du<0", then "dA>0". The above results show that when the subsonic flow accelerates along the streamline of Laval tube 3, the cross-sectional area of the flow must decrease gradually. When air flows at supersonic speeds, the moment when "M>1", if "du>0", then "dA>0"; and if "du<0", then "dA<0". The above results show that when the supersonic flow accelerates along the streamline of Laval tube 3, the cross-sectional area of the fluid increases slowly, and the supersonic flow is inversely proportional to the subsonic flow. In conclusion, the effect is best when the Mach number "M=1" at the throat of Laval tube 3.

According to the embodiment of the present invention, the working process of an air-assisted electrostatic ultrasonic atomization nozzle is as follows.

After a certain pressure of gas enters Laval tube 3 through air inlet 1, it rapidly accelerates from subsonic to supersonic and forms a supersonic flow at the exit of Laval tube 3. Then, supersonic air flows into stepped resonant chamber 5, and a shock wave is generated at the entrance of resonant chamber 5. As the pressure in the cavity increases, the shock wave gradually moves away from the entrance. Therefore, the ultrasonic vibration of the high-speed gas flow in stepped resonant chamber 5 leads to the ultrasonic vibration of the right side of the sealing surface of resonant tube 6. At the same time, the liquid droplet flows from outlet diversion chamber 8 through liquid inlet 7. The outer end of the sealing surface of resonance tube 6 causes the droplet to generate ultrasonic vibration and break. As the static pressure of the sidewall orifice of resonant body 4 decreases gradually, the gas flows out of the V-shaped resonator 15 through gas diversion hole 14 to reach secondary atomization after converging with the liquid drops at the left side face of jet element 9. Then, the high-speed gas-liquid mixture hits vortex blade 13 so that the gas-liquid mixture spirals into the vortex at a high speed. At the same time, piezoelectric sphere 12 is driven to rotate rapidly, and the fluid is accelerated in a short time. At this time, the fluid exerts a certain pressure on the surface of piezoelectric sphere 12, which makes the piezoelectric material produce a positive piezoelectric effect on the surface of piezoelectric sphere 12. Both the inner and outer surfaces of the piezoelectric material have positive and negative charges, and the droplets are positively charged through the surface of the piezoelectric sphere 12. The high-speed gas-liquid mixture is accelerated to supersonic speed through the Laval tube formed by the outer wall of piezoelectric sphere 12 and the inner wall of the moving chamber of piezoelectric sphere 12. Therefore, the mist droplets are further atomized in this process, and finally, the supersonic mist droplets with charged electrostatic electricity are ejected from the air-mist outlet.

In the description of this specification, descriptions referring to the terms "one embodiment", "some embodiments", "examples", "concrete examples", or "some examples" refer to the specific features, structures, materials, or characteristics described in combination with the embodiments or examples that are included in at least one embodiment or example of the invention. The indicated representations of the above terms in this specification do not necessarily refer to the same embodiment or example. In addition, the specific features, structures, materials, or characteristics described may be combined in any one or more embodiments and examples in a suitable manner.

The abovementioned embodiment is the preferred embodiment of the proposed device present invention, but the present invention is not limited to the above embodiment. Any obvious improvement, substitution or modification that a person skilled in the art can make without departing from the gist of the present invention is applicable. It belongs to the embodiment of the present invention and the protection scope of the present invention.

What is claimed is:

1. An air-assisted electrostatic ultrasonic atomization nozzle, comprising an intake sleeve, a Laval tube, a resonant body, and a jet element body, wherein a left end of the intake sleeve is equipped with an air intake, and a right end of the intake sleeve is connected with a left end of the Laval tube;

a right end of the Laval tube is connected with a left end of the resonant body, and a right end of the resonant body is connected with a left end of the jet element body;

a sealing surface of a resonant tube is arranged between the resonant body and the jet element body and allows gas in the resonant body to enter the jet element body through a gas diversion hole of a V-shaped resonant tube;

the resonant body has a resonant chamber, and a sidewall of the resonant body is equipped with the V-shaped resonant tube;

the V-shaped resonant tube is connected with a gas diversion hole of the jet element body; and the jet element body is also equipped with a liquid inlet and a diversion chamber, liquid enters the diversion chamber through the liquid inlet, and then is blown by the gas entered by the gas diversion hole to a rotating device to be ejected through an air-mist outlet.

2. The air-assisted electrostatic ultrasonic atomization nozzle according to claim 1, wherein the rotating device comprises a piezoelectric sphere and a vortex blade;

the piezoelectric sphere is ellipsoidal, and an outer contour is covered with piezoelectric material; and several vortex blades are provided on the piezoelectric sphere.

3. The air-assisted electrostatic ultrasonic atomization nozzle according to claim 1, wherein the rotating device is arranged in a piezoelectric sphere moving chamber, and the rotating device is supported by a supporting rod; and the piezoelectric sphere moving chamber is arranged in the jet element body.

4. The air-assisted electrostatic ultrasonic atomization nozzle according to claim 2, wherein the rotating device is arranged in a piezoelectric sphere moving chamber, and the rotating device is supported by a supporting rod;

the piezoelectric sphere moving chamber is arranged in the jet element body.

5. The air-assisted electrostatic ultrasonic atomization nozzle according to claim 3, wherein a middle section of the piezoelectric sphere moving chamber is a contraction and expanding tube;

a left end of the middle section of the piezoelectric sphere is expanded gradually; and a right end of the middle section of the piezoelectric sphere moving chamber is gradually tapered and contracted.

6. The air-assisted electrostatic ultrasonic atomization nozzle according to claim 4, wherein the outer contour of the piezoelectric sphere and an inner contour of the piezoelectric sphere moving chamber are based on parameters of the Laval tube.

7. The air-assisted electrostatic ultrasonic atomization nozzle according to claim 1, wherein a structure of the resonant chamber is a step type; a left end diameter and a middle section diameter of the resonant chamber are 9 to 11 mm and 5 to 7 mm, respectively; and a right expansion end diameter is 8 to 10 mm.

8. The air-assisted electrostatic ultrasonic atomization nozzle according to claim 1, wherein the liquid inlet is arranged up and down relative to the gas diversion hole.

9. The air-assisted electrostatic ultrasonic atomization nozzle according to claim 1, wherein a gap is formed between an outlet of the diversion chamber and the sealing surface of the resonant tube, the gap is 1 to 2 mm, and a height difference of upper and lower wall surfaces of the diversion chamber is 2 to 3 mm.

10. The air-assisted electrostatic ultrasonic atomization nozzle according to claim 2, wherein a twist angle of the vortex blade is set to 45°.

11. The air-assisted electrostatic ultrasonic atomization nozzle according to claim 2, wherein after a certain pressure of gas enters into the Laval tube through the air intake, a gas flow is rapidly accelerated from subsonic to supersonic, and a supersonic flow is formed at the exit of the Laval tube, then supersonic air flows into a stepped resonant chamber, and at the same time a shock wave is generated at an entrance of the stepped resonant chamber, as a pressure in the stepped resonant chamber increases, the shock wave gradually moves away from the entrance, therefore, an ultrasonic vibration of the supersonic gas flow in the stepped resonant chamber causes an ultrasonic vibration of the sealing surface on the right side of the V-shaped resonant tube, at the same time, the droplets flow from the air-mist outlet of the diversion chamber through the liquid inlet to an outer end of the sealing surface of the V-shaped resonant tube, which causes the droplets to produce ultrasonic vibration and break, as a static pressure of sidewall orifice of the resonant body gradually decreases, the gas flows out of the V-shaped resonant tube, and the gas flows through the gas diversion hole to reach a second atomization after converging with the liquid drops at a left side face of the jet element, subsequently, a high-speed gas-liquid mixture hits the vortex blade, causing the high-speed gas-liquid mixture to swirl into the vortex blade at a high speed, at the same time, the piezoelectric sphere is driven to rotate rapidly and accelerate the fluid in a short time, at this time, the fluid exerts a certain pressure on a surface of the piezoelectric sphere so that the piezoelectric material produces a positive piezoelectric effect on the surface of the piezoelectric sphere, both an inner surface and an outer surface of the piezoelectric material have positive and negative charges, and the droplets are positively charged through the surface of the piezoelectric sphere, the high-speed gas-liquid mixture is accelerated to supersonic speed through the Laval tube formed by an outer wall of the piezoelectric sphere and an inner wall of a piezoelectric sphere moving chamber, therefore, mist droplets are further atomized, and finally, electrostatistically charged supersonic mist droplets are ejected from the air-mist outlet.

12. The air-assisted electrostatic ultrasonic atomization nozzle according to claim 4, wherein a middle section of the piezoelectric sphere moving chamber is a contraction and expanding tube;

a left end of the middle section of the piezoelectric sphere is expanded gradually; and a right end of the middle section of the piezoelectric sphere moving chamber is gradually tapered and contracted.

13. The air-assisted electrostatic ultrasonic atomization nozzle according to claim 11, wherein the rotating device is arranged in a piezoelectric sphere moving chamber, and the rotating device is supported by a supporting rod; and the piezoelectric sphere moving chamber is arranged in the jet element body.

14. The air-assisted electrostatic ultrasonic atomization nozzle according to claim 11, wherein a twist angle of the vortex blade is set to 45°.

* * * * *